United States Patent [19]

De Haitre

[11] 4,145,107

[45] Mar. 20, 1979

[54] TERMINAL ASSEMBLY WITH CAPTIVE SELF-EMERGENT SCREW POST

[75] Inventor: Lon De Haitre, Arlington Heights, Ill.

[73] Assignee: Abbott/Interfast Corporation, Chicago, Ill.

[21] Appl. No.: 867,781

[22] Filed: Jan. 9, 1978

[51] Int. Cl.[2] ..... H01R 9/10

[52] U.S. Cl. ..... 339/263 R

[58] Field of Search ..... 339/253, 254, 255 B, 339/263 R, 269, 271

[56] References Cited

U.S. PATENT DOCUMENTS

| | | | |
|---|---|---|---|
| 3,456,234 | 7/1969 | Lyman, Jr. | 339/254 R |
| 3,816,820 | 6/1974 | Stanaitis | 339/263 R |

FOREIGN PATENT DOCUMENTS

| | | | |
|---|---|---|---|
| 639459 | 12/1936 | Fed. Rep. of Germany | 339/269 |
| 693466 | 7/1953 | United Kingdom | 339/263 R |

*Primary Examiner*—Joseph H. McGlynn

*Attorney, Agent, or Firm*—Silverman, Cass & Singer, Ltd.

[57] ABSTRACT

An electrical terminal assembly of the type adapted to extend through and be press fitted within an insulating terminal block. The assembly includes a cylindrical metal body having a coaxial cylindrical stem emerging from one end for securing one electrical circuit wire, and a captive screw post is adapted to cooperate coaxially with the metal body at its opposite end for securing another circuit wire. To trap the screw post, the body has a hollow bore which is blind at one end (proximal) the bore having an internally threaded section adjacent the proximal end, a larger unthreaded section extended therefrom almost to its open end (distal), and an unthreaded shoulder section at the distal end smaller than the diameters of both the threaded and unthreaded sections. The screw post has a shaft that fits into the bore and a slotted head located exterior of the bore. The post shaft includes a threaded section adjacent its proximal end dimensioned to cooperate with the threaded bore section, and a smaller unthreaded section extended between the threaded section and the slotted head. A helical spring is seated between the blind end of the bore and the proximal end of the post shaft which biases the unthreaded screw post from the bore to its fully extended captive position where the threaded post section engages the body shoulder section.

17 Claims, 5 Drawing Figures

TERMINAL ASSEMBLY WITH CAPTIVE SELF-EMERGENT SCREW POST

BACKGROUND OF THE INVENTION

The invention generally relates to electrical terminal assemblies and particularly relates to an electrical terminal assembly of the type which is to be mounted in a plastic terminal block for the purpose of connecting circuits on the opposite sides of the block.

Although not limited thereto, the invention has applicability to telephone terminal boards where there is a large number of terminal assemblies, for example on half inch centers, the assemblies being permanently connected to circuits from one side of the board and presenting screw posts for temporary or semi-permanent connection to circuits on the other side of the board.

The problems which have arisen from the prior art terminal assemblies are those concerned with the difficulties in manipulating the assemblies to make the desired connections. These connections must be made manually by technicians with the use of screwdrivers. The size of the type of assemblies is small making handling and manipulation difficult. For example, the thickness of the terminal board is of the order of an inch and the screw head may be of the order of ¼ inch in diameter, with other dimensions accordingly. It is difficult to wrap the wires around the shanks of the screw unless the screw is screwed out of the terminal assembly a substantial distance. The screw may often be unscrewed too far and drop out of its socket. This is especially annoying where the terminal board is arranged in a vertical plane and the screw axes are horizontal.

To screw a large number of screws home from positions extending fully out of their sockets is time consuming.

It has been proposed to provide a so-called pop-up screw post in which there is an internally threaded body that is inserted into a hole formed in the terminal block from the bottom side of the block with a reduced diameter shoulder formed in the block itself, adjacent the smaller diameter entrance to the hole. A captured washer of larger outer diameter than the entrance and a plurality of captured washers of smaller diameter than the entrance are carried on a screw post having an unthreaded shank and a threaded proximal end to engage with threaded socket of the body. A helical spring is disposed coaxially with but of larger diameter than the threaded section of the post. The distal end of the post has a slotted head.

In this proposed structure, the entire terminal assembly is forced into the block hole from the bottom side. The head and smaller diameter washers pass through the entrance of the hole and the larger diameter washer engages the inside of the reduced diameter shoulder. The inside diameter of the larger diameter washer is chosen to prevent the threaded section of the post from passing out of the hole; hence the post is captured. This inside diameter of the larger diameter washer is also chosen to have frictional engagement with the unthreaded shank of the screw post.

Theoretically, when the screw post is pushed down and screwed home it is supposed to carry the larger diameter washer with it frictionally to force the spring to load so that when unscrewing the post the post will jump out of the hole to its limit after the threaded section disengages. The technique of capturing washers onto the shank of a screw by rolling the threads and thereby extruding metal into greater diameter than the shank is known. The technique is made difficult when one of the washers must fit the shank tightly. Assuming that this can be effected, there is no assurance that the frictional engagement of shank and large diameter washer will remain sufficient to carry the latter washer further into the hole when the screw post is screwed home. If it remains in place due to the pressure of the internal spring and/or the loosening of the engagement, once screwed home the screw post cannot be self-emergent.

Even if the proposed structure operates in accordance with its theoretical functions, it should be recalled that the entrance of the hole is of a diameter larger than the diameter of the small diameter washers. When the circuit wires are wrapped around the shank of the screw post and the post screwed home, there is no seat for the washers and wires; hence they tend to move down into the entrance and provide no clamping action other than the shear effect due to wires emerging laterally beyond the entrance.

It is not known that the proposed structure has been commercialized.

The invention admirably solves all of the problems of the proposed structure. It provides a positive bias to drive the screw post out of the hollow bore when the external thread of the screw post is free of the internal thread of the bore. There is no need for a special hole with entrance shoulder to be provided in the plastic terminal block since the entire terminal assembly is self-contained. There is no frictionally engaging washer. A solid base or seat is provided for the engagement of the washers and wires onto the assembly itself, independently of the terminal block. There is no need to provide a large entrance to pass the captured wire-engaging washers, hence this entrance passageway which is formed in the terminal assembly itself can be small and provides positive stop means to limit movement of the post during its emergence from the body of the terminal assembly. Less dirt or moisture can get into the hollow bore and wires will not readily be caught thereby.

The entire self-contained terminal assembly is pressed into a hole formed in the terminal block and is ready for use without being concerned with the relative dimensions of the terminal assembly and the length of the hole. This is not true of the proposed device.

The terminal assembly of the invention is made by techniques that are akin to those used to make locknuts of the type having fiber or nylon inserts, that is, where parts are made using automatic screw machines with lips or flanges that are coined into locking engagement with the inserts.

SUMMARY OF THE INVENTION

A terminal assembly to be mounted in an insulating terminal block to provide means for establishing an electrical connection between circuits disposed on respective opposite sides of the terminal block.

The terminal assembly comprises a metal body which is adapted to be installed in a cylindrical hole formed in the terminal block and extending between its first or front side and its rear or second side. There is a screw post whose shaft is engaged in a hollow bore formed in the metal body, the hollow bore having a blind end adjacent the second side of the terminal block comprising its proximal end and an entrance passageway at the distal end of the hollow bore at the second side of the terminal block.

The hollow bore comprises an internally threaded section adjacent the proximal end, an unthreaded section of greater diameter than the root diameter of the threaded section extending from the threaded section to the entrance passageway, and the entrance passageway having an internal diameter less than the root diameter of the threaded section and therefore producing an internal shoulder at the distal end of the bore.

The screw post has its proximal end or a length adjacent such end provided with a threaded section having the same external thread as the internally threaded section of the bore, an elongate shank of a diameter less than the internal diameter of the entrance passageway connecting the threaded section with the distal end of the screw post. The distal end of the screw post is external of the entrance passageway, the distal end of the body forming an integral axial seat with the entrance passageway opening in its center. There is a plurality of wire-engaging washers captured onto the shank between the distal end of the screw post and the seat, said distal end being in the form of a tool engaging head such as one slotted for use with a screwdriver.

Between the proximal end of the screw post and the blind proximal end of the hollow bore there is provided a helical spring which is arranged to be compressed when the screw post is moved into the hollow bore, by straight axial movement before its threads engage with those of the bore and thereafter by rotary screw action. The spring is thus acting during these periods to bias the screw post to be self-emergent. It is long enough and compressed enough so that if the shaft is backed out of engagement with the internal thread of the bore, as soon as it leaves the last thread it will spring outward of the hollow bore until its threaded section comes into engagement with the internal annular shoulder and be biased against such shoulder.

The self-emergent portion of the shank facilitates the winding of a wire or wires around the protruding portion between the washers after which the head may be engaged by a suitable tool, pushed down quickly into the bore to take up on the available unthreaded length of the shank bringing the threaded section of the shaft of the screw post into engagement with the beginning thread of the bore. Thereafter turning the head will cause engagement and locking in place of the washers and wires on the axial seat of the body.

Means are provided on the exterior end of the body opposite the axial seat to enable another conductor to be attached to the terminal assembly from the second side of the terminal block as for example, a stem around which wire can be wrapped or a hollow sleeve which may receive a wire end and be crimped thereto.

DESCRIPTION OF THE PREFERRED EMBODIMENT

The terminal assembly of the invention comprises basically a shell or body having a central movable screw post with its head extending out of a blind bore of the shell and a spring on the interior of the body biasing the post to move out of the bore. The post has two basic positions, one of which is: axially engaged into the bore through the cooperation of screw threads at which time it is adapted to have wires locked under the washers it carries under its head on the unthreaded shank; the second of which is: fully emergent from the bore and free of the threaded engagement therewith, its head being at its maximum outward position.

Figure 1:
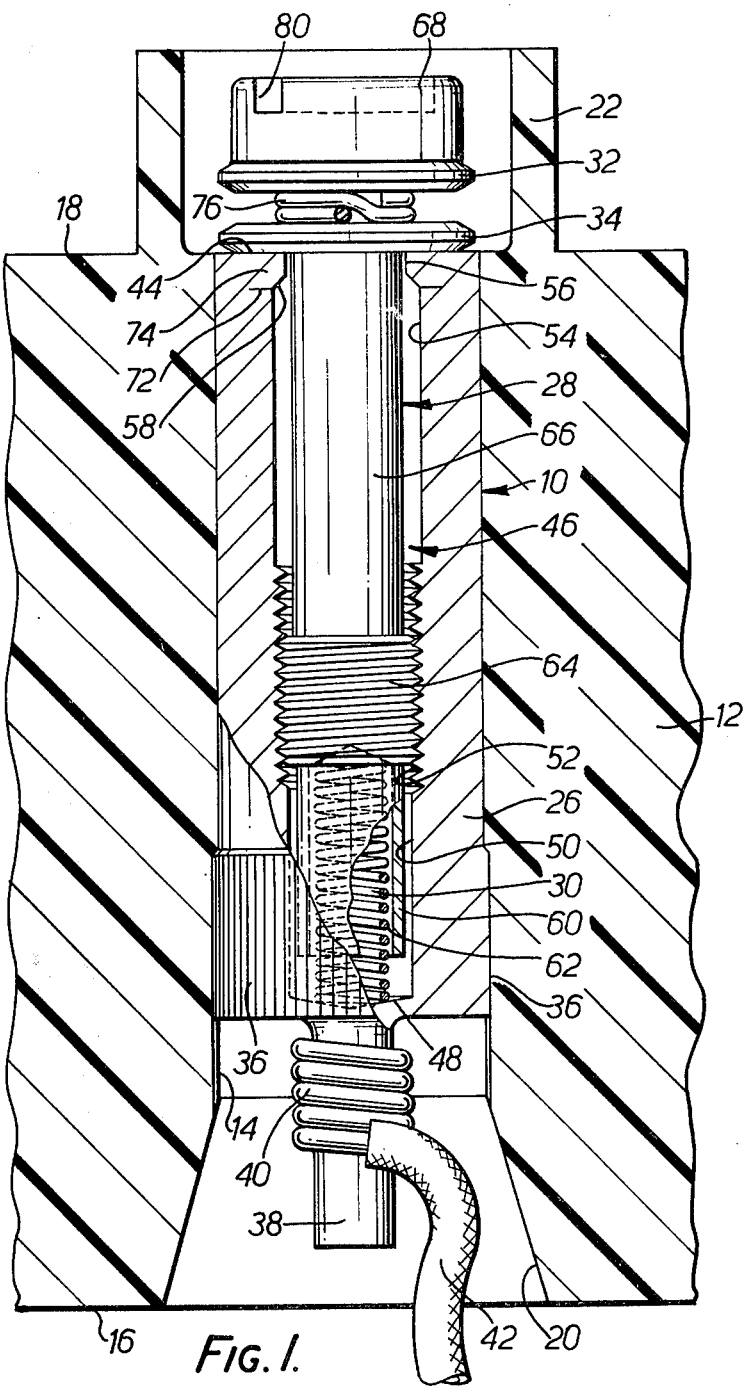
FIG. 1 is a median sectional view with portions shown in elevation of a terminal assembly constructed according to the invention installed in a terminal board and having wires connected thereto.
Figure 2:
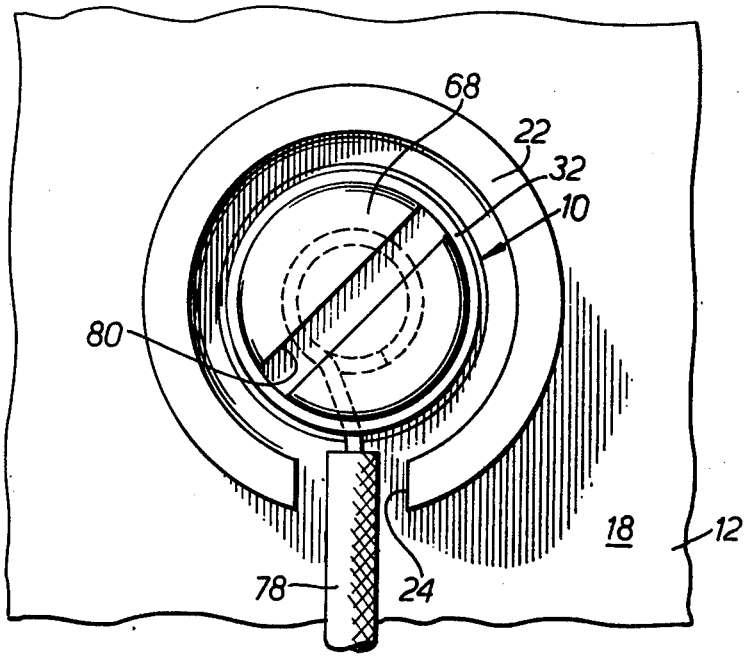
FIG. 2 is a fragmentary top plan view of the same.

In FIGS. 1 and 2 the terminal assembly 10 of the invention is shown installed in a telephone terminal board 12 of some insulating material such as synthetic resin of a conventional type, the terminal assembly 10 being engaged in a passageway 14 that extends fully through the board from its bottom (as viewed in the drawings) surface 16 to its top surface 18. The passageway 14 may have its lower end tapered as at 20 for piloting and to facilitate the entry of the nose of a wire wrap tool for a purpose to be explained.

The terminal board 12 may have on its surface 18 an annular split shroud 22 surrounding the upper end of the passageway 14 for protection of the upper junction formed by the terminal assembly and to confine moisture, the shroud having a slit or gate 24 as shown in FIG. 2 to enable moisture to run off and to provide a path for the connecting wire or wires. A telephone terminal board of the type shown at 12 normally has a large number of terminal assemblies carried thereon, relatively closely spaced apart, for example fifty such terminals on half inch centers. In the views, the dimensions are exaggerated, the thickness of the terminal board 12 being about one inch and the other dimensions being proportional to this. The disposition of the board 12 is normally with the surfaces 16 and 18 in vertical planes so that the axes of the terminal assemblies are horizontal. The surface 18 of the board is considered the front of the board while the surface 16 is considered the rear of the board. Accordingly, that which is shown as the upper end of the terminal assembly 10 would be its front end and that which is shown as the lower end would be its rear end. These ends will be referred to as distal and proximal for convenience.

The shroud 22 is normally disposed so that the gate 24 is downward whereby moisture can run out of the confines of the shroud by gravity.

The terminal assembly 10 that is illustrated is formed of five parts that are individually fabricated and assembled permanently. These parts comprise the shell or body 26, the movable screw post 28, a confined helical spring 30 and two wire-engaging washers 32 and 34 mounted on the screw post 28. The terminal assembly 10 could be made without the wire-engaging washers if the head of the post, to be described, has a large enough flat area on its undersurface or it could be made with one or several wire-engaging washers within the contemplation of the invention. Two washers are preferred for clamping the connecting wire or wires without twisting the same during installation.

The body 26 is an elongate metal member whose exterior surface is preferably cylindrical but for a section 36 which is knurled or otherwise roughened. Its length is somewhat less than the thickness of the terminal board 12 in which it is to be installed. It is provided on its proximal end with an integral stem 38 that can be cylindrical or polygonal in cross section to enable a wire-wrap apparatus to wrap the stripped end 40 of an external circuit wire 42 thereto. The surface of the stem 38 can be roughened for better frictional engagement. The enwrapped end 40 may be soldered in place, if desired.

The body 26 is forced into the passageway 14 whose normal diameter is slightly less than the outer diameter of the knurling 36 so that the knurled section bites into the wall of the passageway and holds the body 26 tightly in place. The body 26 is introduced through the bottom end of the passageway 14 which has the flared taper 20 and is forced in far enough so that the distal seat 44 at the axial front end of the body 26 is flush with the surface 18. This carries the stem 38 well into the passageway 14. The pilot taper 20 is large enough to admit the nose of the wire-wrap tool. Since the surface 16 is intended to be the rear of the terminal block 12 and the circuits connected there are permanently connected, after all of the wires 42 and companions have been suitably attached to the stems of the respective terminal assemblies, the rear end of the passageway 14 including the flared taper 20 may be filled with potting compound.

The center of the body 26 is provided with a hollow bore 46 that extends from the distal seat end at 44 to a blind proximal end 48. In sequence, above the blind end 48 there are provided an unthreaded section 50, a threaded section 52, an unthreaded section 54 and a reduced diameter entrance passageway 56. The unthreaded section 50 is of a diameter which is the same as the inner diameter of the thread root of the threaded section conveniently so that during the fabrication of the bore, the unthreaded proximal section 50 is the proper size to have the thread of the threaded section 52 cut therein. The diameter of the distal unthreaded section 54 is slightly greater than the root diameter of the thread of the threaded section 52 so that a male member having that same thread on its exterior can freely pass through the unthreaded section 54.

The diameter of the entrance passageway 56 is less than the major or outer diameter of the male thread that is intended to engage with the thread of the section 52 but is slightly greater than the diameter of the shank of the screw post as will be described. Thus, there is an undercut shoulder 58 formed at the distal end of the body 26 on the interior thereof, i.e. within the bore 46.

The method for forming this shoulder 58 and the entrance passageway 56 will be explained in connection with FIGS. 4*a* and 4*b*, but for the moment the screw post 28 will be described.

The screw post 28 is an integral metal member, as is the body 26, formed by cold-heading and in which the threads to be described are rolled. Of course, screw machine techniques could be used. The inner or proximal end has a reduced diameter tip 60 whose outer surface is unthreaded and is of a diameter less than the smallest or inside diameter of the female thread of the threaded section 52. This tip 60 is hollow to provide a cylindrical socket 62 that extends a substantial axial distance into the proximal end of the shaft of the screw post 28. The purposes of the socket 62 and the tip 60 will be explained below. Just axially of the tip 60 toward the distal end of the screw post 28 there is provided a short threaded section 64 on the exterior of the shaft of the screw post 28, the shaft being solid throughout with the exception of the socket 62 at its proximal end. The male thread of this section 64 matches and is intended to cooperate with the female thread of the section 52 of the bore 46 so that when engaged with the thread of the section 52 the screw post may be turned to be driven axially into or out of such engagement.

Continuing with the description of the screw post 28, (as viewed in the drawings) above the threaded section 64 toward the distal end of the shaft of the screw post 28 there is an unthreaded shank 66 whose diameter is slightly less than the inner diameter of the entrance passageway 56. When the threaded section 64 is withdrawn from the threaded section 52, the shaft of the screw post 28 can be moved freely in an axial direction without turning the same within the elongate annular tubular chamber defined by the unthreaded section 54 and the shank 66. The shoulder 58 prevents the screw post shaft from being fully withdrawn from the bore 46; hence the screw post 28 is permanently captive therein.

The distal end of the screw post 28 is provided with a driving head 68 which, in this instance, is illustrated as a slotted screw head. The driving head could be of the so-called Philips type or could be provided with an exterior hexagonal cross section for use with a driving socket or with an interior hexagonal cross section socket for use with a so-called Allen type wrench. Between the head 68 and the seat 44 the shank carries the two wire engaging washers 32 and 34 which preferably have a relatively close fit with the shank so that they do not tend readily to slide on the shank 66. The purpose for this arrangement is to cause the washers to tend to move out of the shroud 22 when the screw post is driven to its emergent condition.

The washers 32 and 34 are captive on the screw post 28 independently of the captivation of the screw post shaft by the body 26. During the forming of the screw post 28, following the formation of the head 68 and before the rolling of the threaded section 64 on the shaft, the washers 32 and 34 are engaged onto the formed shank 66. Thereafter the threaded section 64 is rolled on the shaft, resulting in the upsetting of the thread by at least partial extrusion of the shaft which increases the diameter of the screw post at the threaded section.

In the proximal end of the bore 46 there is provided an elongate cylindrical helical spring 30 which has previously been referred to. The bottom (as viewed in the drawings) end of the spring 30 is engaged against the blind end 48 of the bore 46 and a substantial portion of the remainder of the spring 30 is engaged in the socket 62 formed in the tip 60. The spring is compressed during its installation so that it always tends to force the screw post 28 to move axially out of the bore 46. The socket 62 serves to confine the spring 62 and keep it from skewing during use. The shaft of the post 28 could be made considerably shorter without the tip 60 which would thereby be eliminated. In such case the socket 62 would start at the threaded section 64, this latter being formed on the most proximal end of the post 28. Such socket would be required to be deeper into the interior of the shaft. It is preferred to have the tip 60 extending beyond the threaded section 64 for piloting purposes. The screw thread of the section 64 is thus perfectly aligned with the screw thread of the section 52 when the screw post 28 is being driven home and smooth engagement is ensured. Although not likely, there is a possibility of cross threading which this will prevent. The thread gauge in the example illustrated is intended to be 8-32 National Coarse.

The assembly of the parts of the terminal assembly 10 is effected during the period of time that the shoulder 58 is formed in the body 26. After the screw post 28 has been fabricated and assembled with its washers 32 and 34, the spring 30 is dropped into the bore 46 or could be frictionally engaged in the socket 62 and carried into the bore along with the entering portion of the shaft of the screw post 28. At this time the distal end of the body 26 has the formation shown in FIG. 4*a*. The seat 44 starts out as an arcuate annular formation shown at 44', there is an annular notch on the interior of the body 26 at 72' and a large lip of material at 74' which is arranged at an angle of about 45°. The ends of the lip provide the slanted surface 56' and a connecting surface 58'. At this point of the assembly the body 26 is in all other respects completely formed.

Figure 4A:
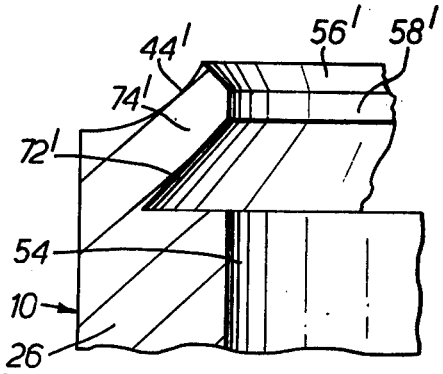
FIGS. 4*a* and 4*b* are fragmentary enlarged sectional views showing the method of forming the entrance shoulder of the bore of the body of the terminal assembly and confining the screw post therein.
Figure 4B:
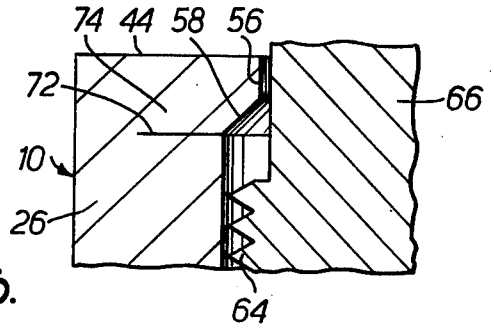
Figure 3:
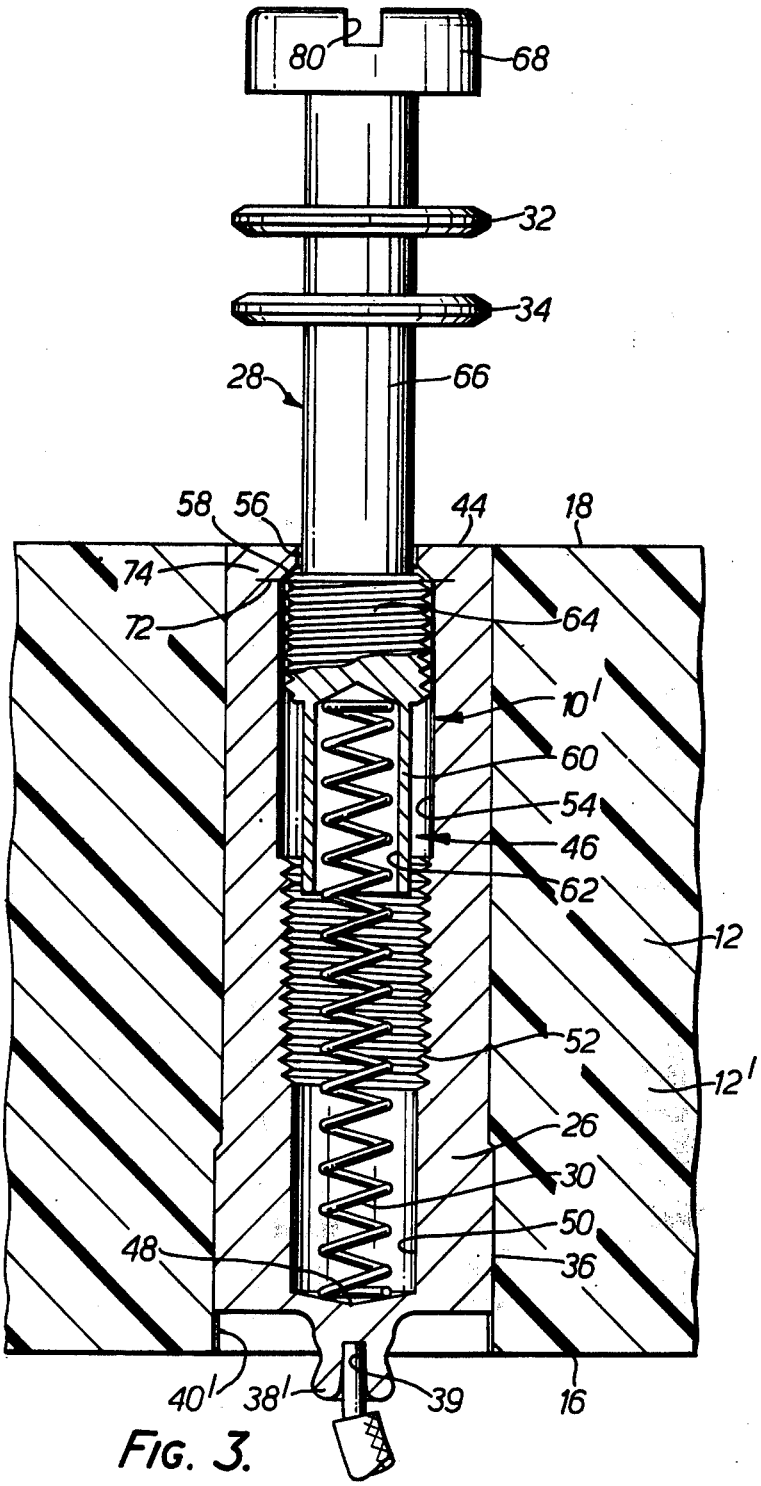
FIG. 3 is a sectional view similar to that of FIG. 3 but of a slightly modified form of the invention, the screw post of the terminal assembly being shown in its maximum emergent condition.

After the shaft of the post 28 has been inserted with its washers 32 and 34 maintained on the shank 66 outside of the bore 46, the lip 74' is coined downwardly as viewed in FIG. 4*a* to close the notch 72' and the resulting structure is as shown in FIG. 4*b*, this being the same as the equivalent parts of FIGS. 1 and 3. The arcuate surface 44' becomes the seat 44; the slanted surface 56' becomes the small diameter entrance passageway 56; the surface 58' becomes the shoulder 58; and the notch 72' closes to become a confined interface 72 between the distal formation 74 and the bulk of the body 26. This captivates the screw post 28.

The use of the assembly 10 is relatively simplified because of its construction. After the connection of the wire 42 and the potting of the cavity represented by the open bottom of the passageway 14 in FIG. 1, the condition of the post may be assumed to be fully emergent. In this condition the head 68 and most of the shank 66 are out of the bore 46 much like the illustration of FIG. 3. The washers 32 and 34 are separated by the technician if they are not already separated because of their frictional adherence to the shank 66 and a couple of wraps of the stripped end 76 of a circuit wire 78 are taken around the shank 66 between the washers 32 and 34. If desired another wire may be wrapped around the shank 66 between washer 34 and seat 44. The technician then engages his screwdriver blade into the slot 80 of the head 68 and pushes the screw post 28 bodily and axially into the bore 46 of the body 26. This is done against the pressure of the spring 30 which compresses during this act. When he feels resistance due to the initial engagement of the lead threads of the threaded section 64 with those of the section 52 the technician commences to turn his screwdriver in the proper direction for causing threaded engagement. The shaft of the screw post now moves further into the bore 46 further compressing the spring 30 until the lower washer 34 and any wires which may be below it engage on the seat 44. The tightening of the screw post 28 with another partial turn or so of the head 68 compresses the loops of wire and the connection is complete.

During this manipulation, the technician maneuvers the wire lead 78 and any others that are used so that same extend out of the gate 24. The completed condition of the terminal assembly 10 and its connected wires is shown in FIGS. 1 and 2, the head 68 being shown below the outermost height of the shroud 22. Heavier wire instead of that shown at 78 and 76 will result in the entire screw post moving a lesser distance into the bore 46 with a greater protrusion of the head 68.

When the connection of the wire 78 with the terminal assembly is to be removed, replaced with another lead wire or added to, the technician applies a tool to the head 68 and unscrews it. The threaded section 64 is thus moved axially towards the distal end of the body 26 and gradually works its way out of the threaded section 52. As soon as the last thread is clear of the section the compression which the spring 30 had been subjected to suddenly drives the screw post 28 outward of the bore 46, the threaded section 64 freely moving through the unthreaded section 54 and coming into engagement with the shoulder 58 which stops its movement. There being a substantial length of the shank 66 now protruding with the washers 32 and 34 and the loops of wire 76 the technician easily can remove the connection 76 and/or replace it with another or add to it. When there is no connection desired to be made to a terminal assembly, it being intended to leave it blank, the technician can push the screw post 66 into the bore, make a partial turn or so of the head 68 to cause a few threads of the section 64 to engage with the threaded section 52 and thereby temporarily lock the screw post 66 in place. It is thus less likely to cause interference with the wires of other terminal assemblies of the terminal board and less likely to interfere with the work of the technician on other parts of the board.

The terminal assembly 10' of FIG. 3 is identical in all respects with that of FIG. 1 except for a slight modification. Here, instead of a stem 38 there is a short stem 38' with an axial socket 39 formed therein. The wire 42' has a short stripped stub end 40' which is inserted into the socket 39 and crimped in place. No other modifications of the terminal assembly are shown hence all of the reference numerals are identical with those of FIG. 1. In this case, the terminal assembly 10' is shown with the screw post 66 fully emergent and the spring 30 fully extended. Also, the terminal board 12' is of slightly different construction in that there is no shroud 22, the surface 18 being fully planar. Also the passageway 40' is shorter than the passageway 40 so that the cavity resulting is smaller at the bottom of the view.

Variations of the details of the invention are capable of being made without departing from the spirit or scope of the invention as defined in the appended claims.

What it is desired to secure by Letters Patent of the United States is:

1. An electrical terminal assembly adapted to be installed in an insulating terminal block for providing connections at opposite ends thereof to external electrical circuits which comprises:

A. a shell of metal having a blind-ended bore therein and a screw post having a shaft at least a portion of which is disposed within the bore and having a drive head on an end thereof exterior of the shell adapted to cooperate with a seat formed on the axial external end of the shell adjacent the entrance of the bore to clamp conductor means to the shell, B. means on the interior of the bore and the exterior of the screw post cooperating to provide a screw engagement of the screw post and shell but only when a substantial portion of the shaft of the screw post is axially within the bore, C. spring means within the bore and biasing the shaft of the post to be driven out of the bore, D. stop means in the bore at the entrance on the interior thereof limiting the movement of the shaft of the post in its emerging direction, and E. the cooperating means on the interior of the bore and the exterior of the screw post being arranged and dimensioned so that when free of the screw engagement the shaft of the post is free to move axially without rotation to the limit defined by said stop means.

2. An electrical teminal assembly as claimed in claim 1 in which the cooperating means include an externally threaded section on the shaft and an unthreaded shank section between the head and externally threaded section, the shank being capable of passing the stop means but the threaded section being unable to do so.

3. An electrical terminal assembly as claimed in claim 2 in which the stop means comprise an internal shoulder which is undercut relative to the remainder of the bore, the bore entrance including a passageway freely passing the shank section but smaller than the outer diameter of the externally threaded section, the externally threaded section adapted to engage against and be stopped by the internal shoulder.

4. An electrical terminal as claimed in claim 1 in which the spring means comprise a helical spring engaged between the proximal end of the shaft and the blind end of the bore.

5. An electrical terminal as claimed in claim 4 in which the proximal end of the shaft has means seating the spring.

6. An electrical terminal as claimed in claim 5 in which said last mentioned means comprise an axial socket.

7. An electrical terminal as claimed in claim 2 in which the cooperating means include an internally threaded section adjacent the blind end of the bore adapted threadedly to engage with said externally threaded section.

8. An electrical terminal as claimed in claim 7 in which said shaft has a short unthreaded reduced diameter section at its proximal end for piloting the engagement of the threaded sections.

9. An electrical terminal as claimed in claim 8 in which said unthreaded reduced diameter section is provided with an axial socket for seating said spring means.

10. An electrical terminal assembly adapted to be installed in an insulating terminal block and comprising:

A. an elongate generally cylindrical body member of metal having an axial bore and distal and proximal ends, the bore opening to and having an entrance passageway leading from an external seat formed on the distal end of the body member, the bore having a blind end adjacent the proximal end of the body member, B. an elongate metal screw post partially disposed within the bore and having distal and proximal ends, having a drive head at its distal end provided with means for clamping a conductor against the seat, the screw post having at least an unthreaded shank axially inward of the head separating the head from the proximal end of the screw post, C. an externally screw threaded section provided on the screw post adjacent the proximal end thereof and located on the portion of the screw post which is within the bore, the interior of the bore having an internally screw threaded section axially spaced from its distal end by an unthreaded section, said internally threaded section adapted to cooperate with the externally screw threaded section whereby the head may be rotated to cause engagement or disengagement of the screw threaded sections with one another but engagement or disengagement not occurring unless there is a substantial portion of the screw post within the bore, by reason of the screw threaded sections being spaced from the distal ends of both the screw post and body, D. a spring located in the bore between the blind end and the proximal end of the screw post biased to drive the screw post out of the bore when its externally threaded section is not engaged with the internally threaded section of the bore and adapted to be compressed during axial movement of the screw post inwardly of the bore, E. the unthreaded section of the bore having a diameter of a dimension permitting free axial passage of the externally screw threaded section and F. means at the entrance passageway to limit axial movement of the screw post by the spring bias tending to push said screw post out of the bore whereby the screw post is permanently captured within the bore.

11. The terminal assembly as claimed in claim 10 in which the clamping means comprise at least one washer engaged on the shank on the exterior of the bore.

12. The terminal assembly as claimed in claim 10 in which the means at the entrance passageway comprise an undercut shoulder adjacent the passageway on the interior of the bore at its distal end, the entrance passageway being larger in diameter than the shank but smaller in diameter than the externally threaded section whereby when the spring has pushed the post in an axial direction tending to move same out of the bore, the externally threaded section will come into engagement with and be stopped by the shoulder after passing through the unthreaded section of the bore.

13. The terminal assembly as claimed in claim 10 in which there are means to secure a second conductor to the external proximal end of the body member.

14. The terminal assembly as claimed in claim 10 in which the proximal end of the screw post is provided with structure for seating the spring.

15. The terminal assembly as claimed in claim 10 in which the proximal end of the screw post is provided with a hollow socket for seating the spring therein.

16. The terminal assembly as claimed in claim 10 in which the proximal end of the screw post has a short unthreaded section on its exterior of a diameter slightly less than the diameter of the internally threaded section whereby to pilot the screw post externally threaded section into threaded engagement with the said internally threaded section during rotary and axial movement of the post intended to cause such engagement.

17. The terminal assembly as claimed in claim 10 in which the proximal end of the screw post is provided with a short unthreaded section on its exterior of a diameter slightly less than the diameter of the internally threaded section and on its interior with an axial socket, the socket serving to seat the spring therein and the short unthreaded section acting to pilot the screw post externally threaded section into threaded engagement with said internally threaded section during rotary and axial movement of the screw post intended to cause such engagement.

* * * * *